United States Patent [19]

Lobaugh et al.

[11] 3,948,013

[45] Apr. 6, 1976

[54] COLD FORGED STEEL GRATING

[76] Inventors: Lawrence E. Lobaugh, 132 Wilson Ave., Niles, Ohio 44446; Thomas S. Gallo, 1119 Marshall Road, McDonald, Ohio 44437

[22] Filed: May 7, 1975

[21] Appl. No.: 575,464

[52] U.S. Cl. ..... 52/669; 52/758 A; 29/160; 29/509; 29/522

[51] Int. Cl.[2]..... E04C 2/42; E04C 5/04; B23P 5/12

[58] Field of Search ..... 29/160, 509, 522; 52/669, 52/664–668, 180, 660, 758 A; 105/457

[56] References Cited

UNITED STATES PATENTS

| | | | |
|---|---|---|---|
| 194,541 | 8/1877 | Stark | 29/160 |
| 857,724 | 6/1907 | Dean | 52/758 X |
| 1,734,660 | 11/1929 | Williams et al. | 52/758 A |
| 2,155,694 | 4/1939 | Tench | 29/160 |
| 2,169,649 | 8/1949 | Knapp et al. | 29/160 |
| 2,208,020 | 7/1940 | Delanty | 105/457 |
| 2,241,952 | 5/1941 | Lachman | 29/160 |
| 2,656,903 | 10/1953 | Kerrigan | 52/669 |

*Primary Examiner*—Frank L. Abbott
*Assistant Examiner*—James L. Ridgill, Jr.
*Attorney, Agent, or Firm*—Webster B. Harpman

[57] ABSTRACT

A cold forged steel grating is formed of a plurality of spaced parallel bearing bars secured to one another by a plurality of spaced parallel cross rods engaged in openings in the bearing bars adjacent their uppermost surfaces with the metal of the bearing bars adjacent the cross rods cold forged into engagement therewith and the metal of the cross rods adjacent the bearing bars flatened by cold forging to forcefully engage the opposite sides of said bearing bars and forming a sturdy rigid grating structure.

6 Claims, 3 Drawing Figures

COLD FORGED STEEL GRATING

BACKGROUND OF THE INVENTION

1. Field of the Invention

This invention relates to steel gratings of the type normally used for area ways, floor and sidewalk openings, platforms, stair treads and the like.

2. Description of the Prior Art

Prior structures of this type usually employ an assembly of bearing bars or flat metal plates held in spaced parallel relation by a plurality of cross bars welded cross wise of the bearing bars at or below the upper surfaces of the bearing bars, as for example in U.S. Pat. No. 2,656,903. Upon occasion edge frames are attached to the ends of the assembled bearing bars and cross bars by welding the same thereto to complete the grating.

This invention eliminates the welding heretofore believed necessary in forming such steel grating structures, avoids the warpage commonly found in such welded structures as a result of heat distortion and provides a more economically formed steel grating.

SUMMARY OF THE INVENTION

A cold forged steel grating is disclosed in which spaced parallel bearing bars of rectangular cross section are positioned on their edges and provided with oppositely disposed aligned openings adjacent their uppermost edges through which a plurality of cross rods are positioned and secured in such position by cold forging of the metal of the bearing bars and cross rods to complete the structure.

DESCRIPTION OF THE PREFERRED EMBODIMENT

In the form of the invention chosen for illustration herein, the cold forged steel grating consists of a plurality of spaced parallel bearing bars 10, each of which is rectangular in cross section and positioned on their edges with their upper edges provided with a continuous series of notches 11 and a plurality of spaced aligned openings 12.

Figure 2:
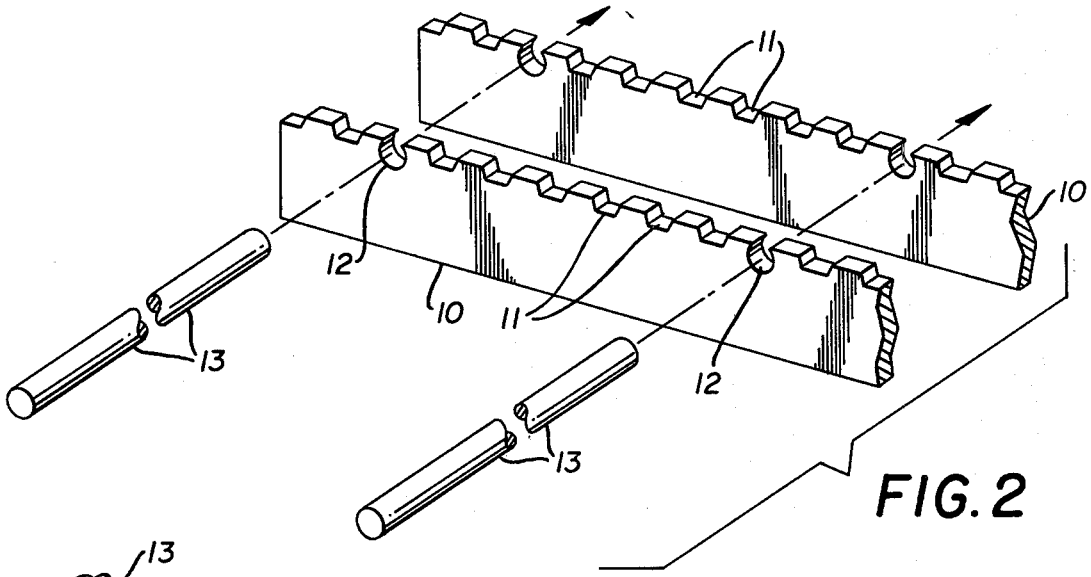
FIG. 2 is an exploded perspective elevation of some of the components of the grating seen in FIG. 1.

A plurality of cross sectionally round cross rods 13 are positioned longitudinally through the oppositely disposed aligned openings 12 in the bearing bars 10 as seen in the exploded illustration comprising FIG. 2 of the drawings.

Figure 1:
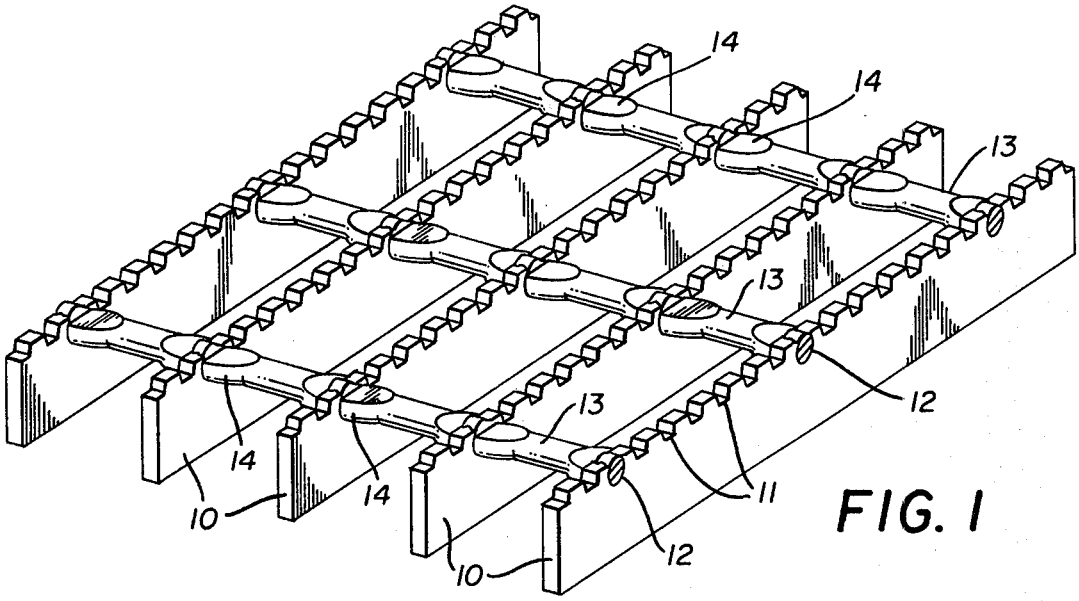
FIG. 1 is a perspective elevation of a cold forged steel grating formed in accordance with the invention.
Figure 3:
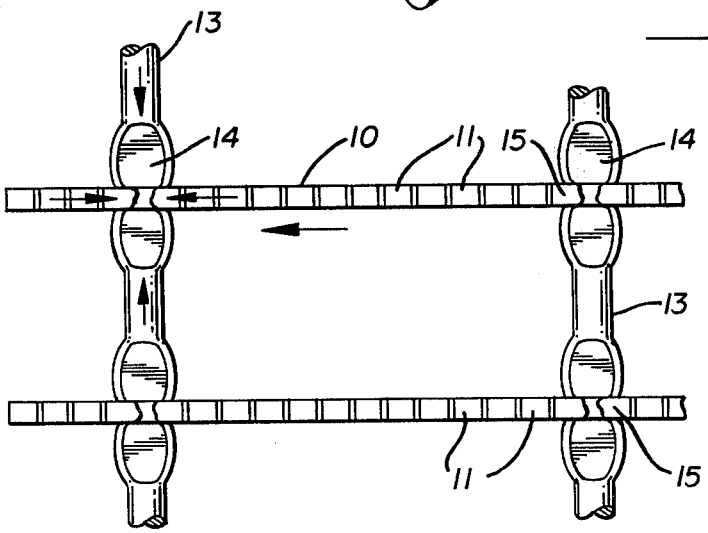
FIG. 3 is a top plan view of a portion of the steel grating of FIG. 1 in enlarged detail and illustrating the reshaping of the metal of the components by cold forging.

When a desired number of the bearing bars 10 and the cross rods 13 have been so assembled they are subjected to a cold forging operation to distort the metal of the bearing bars adjacent the cross rods 13 in the openings 12 so as to forcefully engage the same and simultaneously cold forging pressure is applied to the top and bottom surfaces of the cross rods 13 immediately adjacent each of the sides of the bearing bars 10 so as to distort and reshape the metal of the cross rods to a semi-flattened shape 14 of a greater width than the openings 12 in the bearing bars 10 through which they are positioned. The resulting cold forged steel grating is illustrated in FIG. 1 of the drawings and a portion thereof is illustrated in enlarged detail in FIG. 3 of the drawings and by referring thereto it will be observed that the substantial flattening of the top and bottom surfaces of the cross rods 13 adjacent the opposite sides of each of the bearing bars 10 results in a substantially changed configuration thereof and creates sidewardly extending portions of the distorted bars in tight clamping engagement against the opposite sides of each of the bearing bars 10.

The cold forging pressure applied to the top edges of the bearing bars 10 adjacent the openings 12 in which the rods 13 are positioned not only moves metal toward and around the upper surfaces of the cross rods 13, but additionally provides additional irregularities in the contour of the upper edges of the bearing bars 10 which contribute to their non-skid characteristics which as hereinbefore set forth are primarily the result of the spaced notches 11 formed therein. A further advantage is seen in that the reshaping of the metal of the cross rods 13 as indicated by the numerals 14 creates still additional irregular uppermost surfaces of the steel grating which again contribute to its non-slip characteristics which is highly desirable.

The above described structure provides a cold forged steel grating that is economically and rapidly formed without welding and the resulting distortion of the components and with the advantages of the retention of the original straight lines of the components and the improved anti-skid configurations in the uppermost surface thereof.

Although but one embodiment of the present invention has been illustrated and described, it will be apparent to those skilled in the art that various changes and modifications may be made therein without departing from the spirit of the invention.

Having thus described our invention what we claim is:

1. A grating comprising a plurality of similar load bearing spaced parallel longitudinally extending bearing bars, the upper edges of said bearing bars each having a plurality of longitudinally spaced notches therein and a plurality of longitudinally spaced openings therethrough, the openings of one bearing bar being disposed in transverse alignment with the openings in the adjacent bearing bars and a plurality of load bearing spaced straight parallel cross rods positioned through said openings in said bearing bars, portions of said bearing bars adjacent said openings overlying portions of the cross rods in clamping engagement with said cross rods and portions of said cross rods adjacent said bearing bars flattened and into clamping engagement with said bearing bars, said flattened portions of said cross rods engaging said bearing bars being relatively wider than said openings therein.

2. The grating of claim 1 and wherein said openings in said bearing bars communicate with said upper edges thereof.

3. The grating set forth in claim 1 and wherein said openings in said bearing bars are open at their upper portions to the upper edges of said bars and the parts of the upper edges adjacent said openings overlie at least part of said openings.

4. The grating set forth in claim 1 and wherein the bearing bars are narrow elongated flat plates standing on edge and the cross rods are of uniform cross section when assembled through said openings therein.

5. The grating of claim 1 and wherein the portions of the bearing bars and the flattened portions of the cross rods that are clamping engagement with one another are formed by cold forging.

6. The grating set forth in claim 5 and wherein said openings are round and said cross rods are cross sectionally round and fit snuggly in said openings prior to said forging.

* * * * *